US008567506B2

(12) United States Patent
Vick, Jr. et al.

(10) Patent No.: US 8,567,506 B2
(45) Date of Patent: Oct. 29, 2013

(54) FLUID ISOLATING PRESSURE EQUALIZATION IN SUBTERRANEAN WELL TOOLS

(75) Inventors: James D. Vick, Jr., Dallas, TX (US); Jimmie R. Williamson, Jr., Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 1168 days.

(21) Appl. No.: 12/204,346

(22) Filed: Sep. 4, 2008

(65) Prior Publication Data

US 2010/0051260 A1 Mar. 4, 2010

(51) Int. Cl.
*E21B 34/06* (2006.01)

(52) U.S. Cl.
USPC ..... 166/324; 166/66.6; 166/332.7; 166/386

(58) Field of Classification Search
USPC ..... 166/66.6, 324; 417/423.11
See application file for complete search history.

(56) References Cited

U.S. PATENT DOCUMENTS

| | | | | | |
|---|---|---|---|---|---|
| 2,556,435 | A | * | 6/1951 | Moehrl et al. | 417/367 |
| 4,537,457 | A | | 8/1985 | Davis, Jr. et al. | |
| 4,598,773 | A | * | 7/1986 | Pringle | 166/373 |
| 4,700,272 | A | | 10/1987 | Bellamy | |
| 4,976,317 | A | * | 12/1990 | Leismer | 166/321 |
| 5,038,865 | A | | 8/1991 | Taylor | |
| 5,058,682 | A | * | 10/1991 | Pringle | 166/324 |
| 5,310,004 | A | * | 5/1994 | Leismer | 166/321 |
| 5,947,206 | A | * | 9/1999 | McCalvin et al. | 166/324 |
| 6,012,518 | A | | 1/2000 | Pringle | |
| 6,041,857 | A | | 3/2000 | Carmody et al. | |
| 6,179,055 | B1 | | 1/2001 | Sallwasser | |
| 6,250,387 | B1 | | 6/2001 | Carmichael et al. | |
| 6,269,874 | B1 | | 8/2001 | Rawson | |
| 6,293,346 | B1 | * | 9/2001 | Patel | 166/373 |
| 6,301,829 | B1 | | 10/2001 | Kaufmann | |
| 6,367,545 | B1 | | 4/2002 | Buskirk | |
| 6,450,258 | B2 | | 9/2002 | Green | |
| 6,575,236 | B1 | * | 6/2003 | Heijnen | 166/66.4 |
| 6,619,388 | B2 | | 9/2003 | Dietz | |
| 6,688,860 | B2 | * | 2/2004 | Du et al. | 417/423.11 |
| 6,978,842 | B2 | | 12/2005 | Read | |
| 6,981,853 | B2 | * | 1/2006 | Du et al. | 417/414 |

(Continued)

OTHER PUBLICATIONS

International Search Report and Written Opinion issued Oct. 13, 2009, for International Patent Application Serial No. PCT/US09/055187, 6 pages.

(Continued)

*Primary Examiner* — Jennifer H Gay
(74) *Attorney, Agent, or Firm* — Smith IP Services, P.C.

(57) ABSTRACT

A fluid isolating pressure equalization in a subterranean well. A well system includes a well tool including a chamber therein containing an electrical assembly in a dielectric fluid, and a pressure equalization apparatus including a flowpath having opposite ends. One end is connected to the chamber, and the other end is connected to a source of another fluid. The flowpath extends alternately upward and downward between the opposite ends. A pressure equalization apparatus for use with a well tool in a subterranean well includes multiple spiral wraps of a tube. A flowpath in the tube extends in opposite directions in respective successive wraps of the tube.

20 Claims, 8 Drawing Sheets

(56) References Cited

U.S. PATENT DOCUMENTS

| | | | | |
|---|---|---|---|---|
| 7,217,107 | B2 * | 5/2007 | Du et al. | 417/414 |
| 7,219,752 | B2 * | 5/2007 | Wassell et al. | 175/321 |
| 2002/0192090 | A1 | 12/2002 | Du et al. | |
| 2004/0136849 | A1 * | 7/2004 | Du et al. | 417/423.11 |
| 2007/0284117 | A1 * | 12/2007 | Smithson | 166/385 |
| 2010/0051260 | A1 | 3/2010 | Vick, Jr. et al. | |
| 2010/0147064 | A1 | 6/2010 | Difoggio | |

OTHER PUBLICATIONS

International Search Report with Written Opinion issued Oct. 25, 2012 for PCT Patent Application No. PCT/US12/030669, 11 pages.

International Preliminary Report on Patentability issued Mar. 17, 2011 for International Patent Application Serial No. PCT/US09/55187, 5 pages.

* cited by examiner

FLUID ISOLATING PRESSURE EQUALIZATION IN SUBTERRANEAN WELL TOOLS

BACKGROUND

The present disclosure relates generally to equipment utilized and operations performed in conjunction with a subterranean well and, in an embodiment described herein, more particularly provides for fluid isolating pressure equalization in subterranean wells.

Various methods have been used to provide for pressure equalization in well tools. Such pressure equalization may be desirable, for example, to prevent excessive stress due to pressure differentials across walls of the well tools.

Devices such as bellows, membranes, floating pistons, etc. have been used in the past to provide for pressure equalization. However, each of these has disadvantages. Floating pistons are notorious for sticking and require dynamic seals, which may leak. Bellows are expensive to manufacture, and typically have extensive lengths of welds, which are prone to leakage. Membranes are inherently weak and prone to fatigue failure.

Therefore, it will be appreciated that advancements are needed in the art of pressure equalization in subterranean wells.

SUMMARY

In the present specification, a manner of pressure equalization is provided which solves at least one problem in the art. One example is described below in which a pressure equalization apparatus is used to isolate a chamber in a well tool from an external fluid. Another example is described below in which the apparatus includes a tube which extends alternately upward and downward to prevent migration of a fluid through the apparatus, while still permitting pressure communication through the apparatus.

In one aspect, a well system is provided. The well system includes a well tool with a chamber therein containing an electrical assembly in a dielectric fluid. A pressure equalization apparatus includes a flowpath having opposite ends, with one end being connected to the chamber, and the other end being connected to a source of another fluid. The flowpath extends alternately upward and downward between the opposite ends.

In another aspect, a pressure equalization apparatus is provided for use with a well tool in a subterranean well. The apparatus includes multiple spiral wraps of a tube. A flowpath in the tube extends in opposite directions in respective successive wraps of the tube.

These and other features, advantages, benefits and objects will become apparent to one of ordinary skill in the art upon careful consideration of the detailed description of representative embodiments hereinbelow and the accompanying drawings, in which similar elements are indicated in the various figures using the same reference numbers.

DETAILED DESCRIPTION

It is to be understood that the various embodiments described herein may be utilized in various orientations, such as inclined, inverted, horizontal, vertical, etc., and in various configurations, without departing from the principles of the present disclosure. The embodiments are described merely as examples of useful applications of the principles of the disclosure, which are not limited to any specific details of these embodiments.

In the following description of the representative embodiments of the disclosure, directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore.

Figure 1:
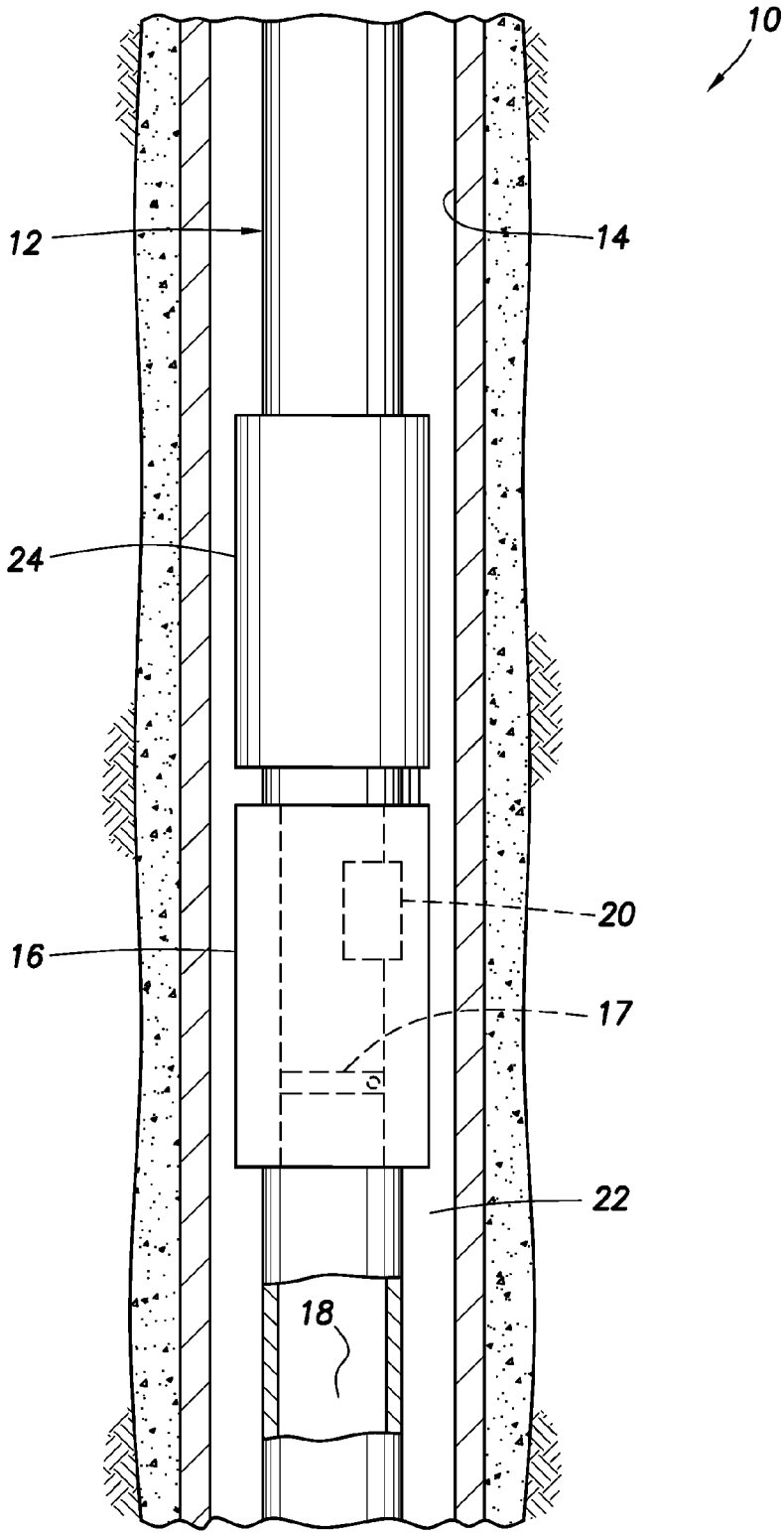
FIG. 1 is a schematic partially cross-sectional view of a well system embodying principles of the present disclosure.

Representatively illustrated in FIG. 1 is a well system 10 which embodies principles of the present disclosure. As depicted in FIG. 1, a tubular string 12 is positioned in a wellbore 14. A well tool 16 is interconnected in the tubular string 12.

The well tool 16 could be any type of well tool, such as a flow control device (e.g., a production valve, safety valve, choke, injection control valve, etc.), sensor, telemetry device, etc., or any combination of well tools. Representatively, in this example the well tool 16 is a safety valve for selectively permitting and prevent flow through an internal longitudinal flow passage 18 of the tubular string 12 (e.g., utilizing a closure device 17, such as a flapper or ball, to close off the flow passage).

A chamber 20 is positioned within the well tool 16. It is desired in the well system 10 to maintain equal pressure between the chamber 20 and either the flow passage 18 or an annulus 22 formed radially between the tubular string 12 and the wellbore 14. For this purpose, a pressure equalization apparatus 24 is interconnected between the chamber 20 and the passage 18 or annulus 22.

The apparatus 24 is used to equalize pressure, while also preventing fluid in the passage 18 or annulus 22 from entering the chamber 20. For example, the chamber 20 could contain equipment which could be damaged or rendered inoperative by the fluid in the passage 18 or annulus 22.

Figure 2:
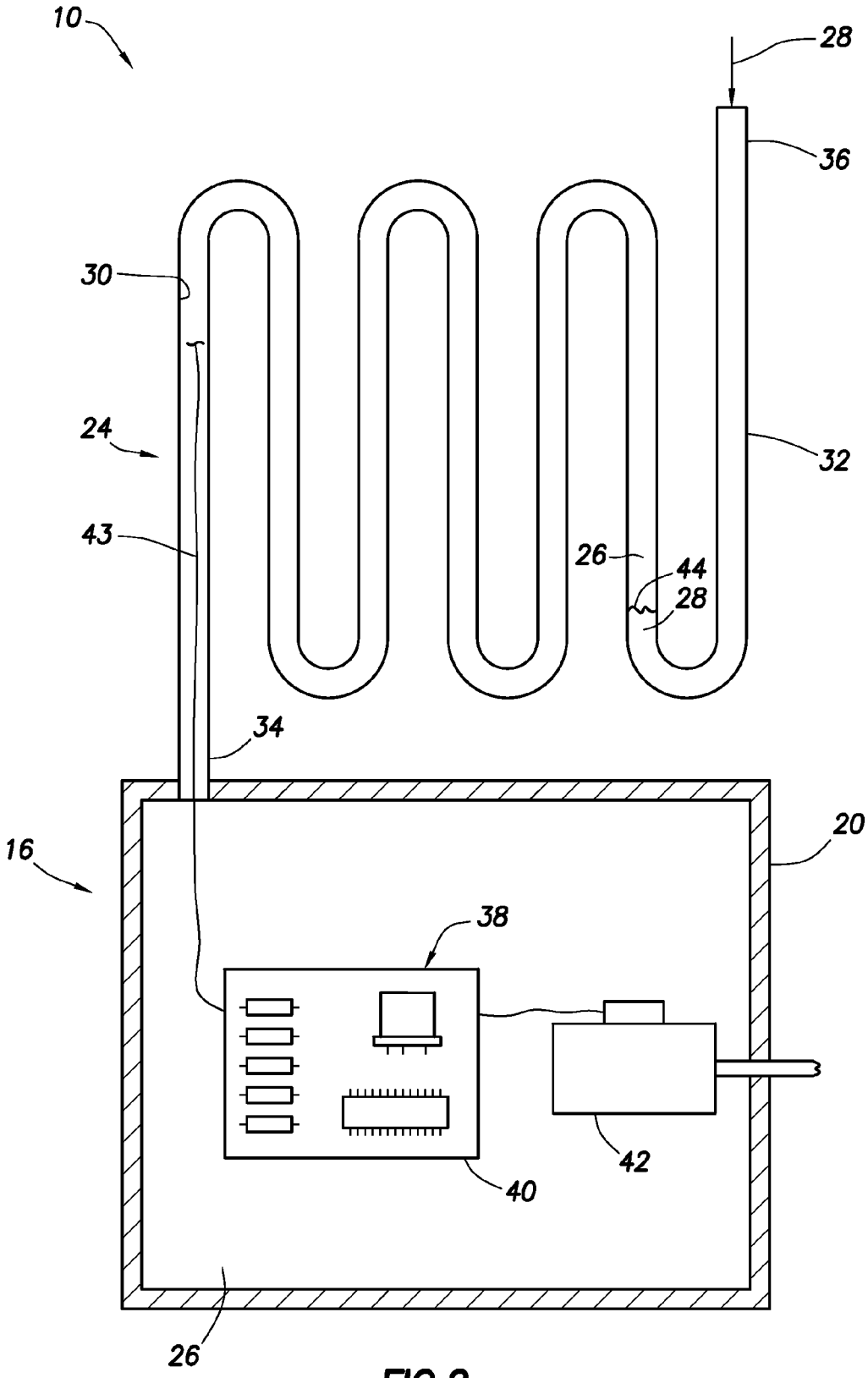
FIG. 2 is an enlarged scale schematic cross-sectional view of a well tool and pressure equalization apparatus which may be used in the well system of FIG. 1.
Figure 3B:
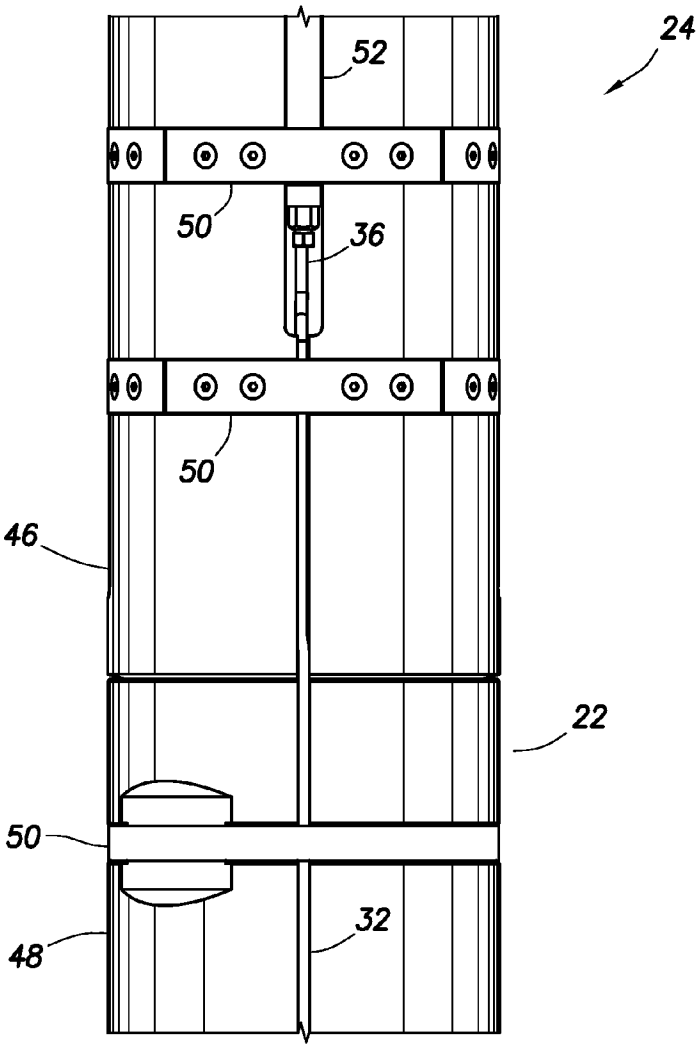
FIGS. 3A-D are detailed elevational views of successive axial sections of the apparatus.
Figure 3A:
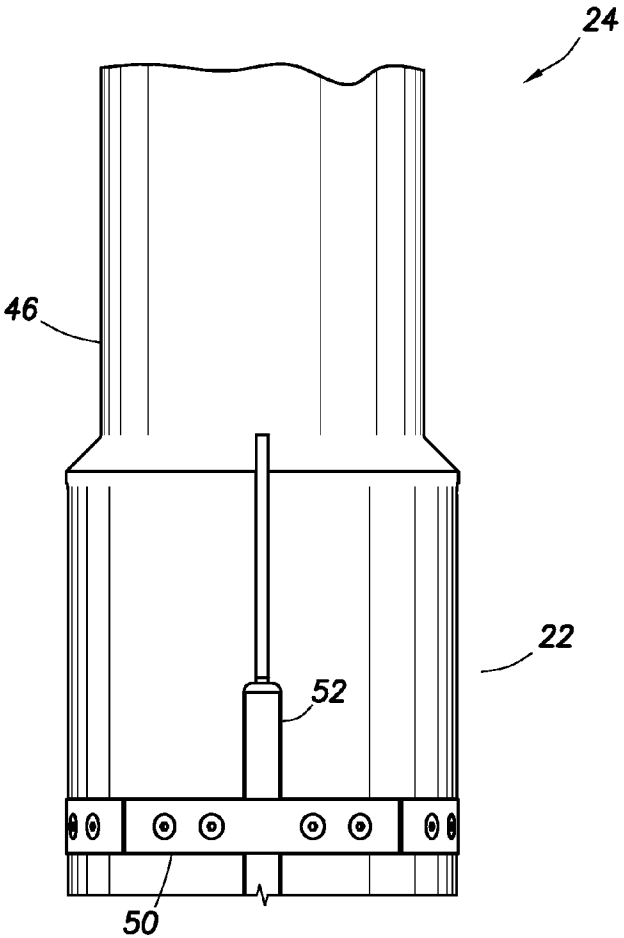
Figure 3D:
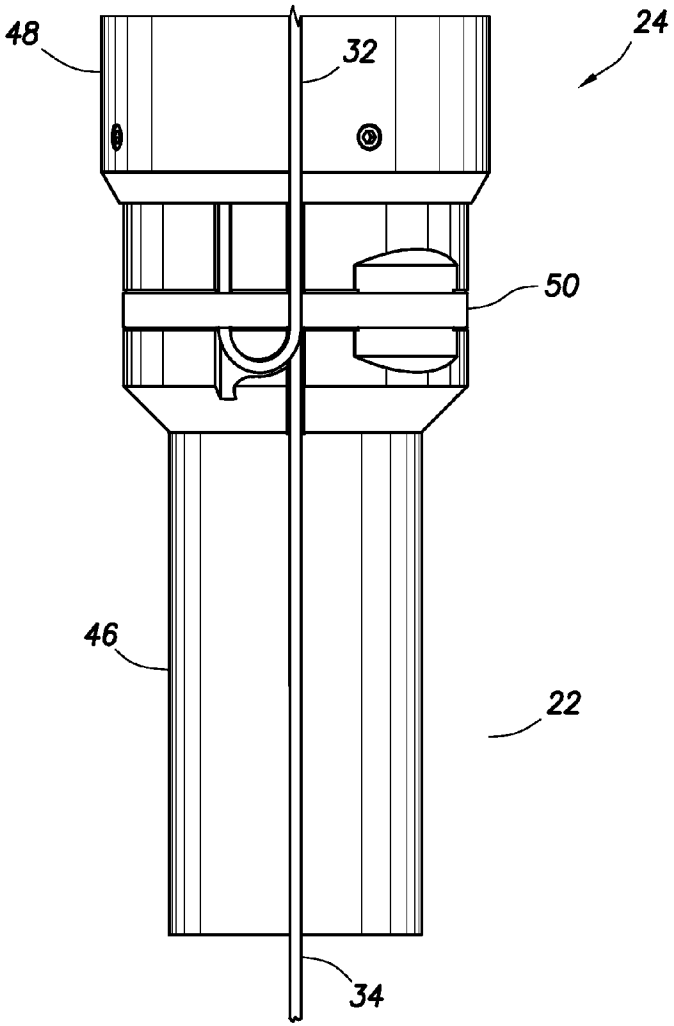
Figure 3C:
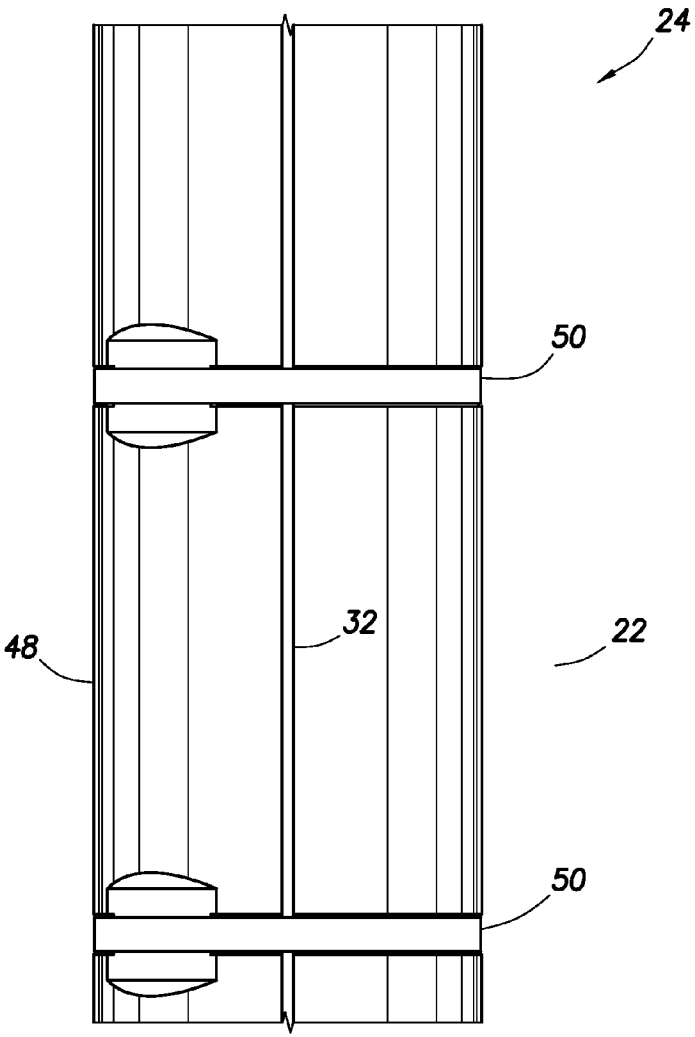
Figure 4A:
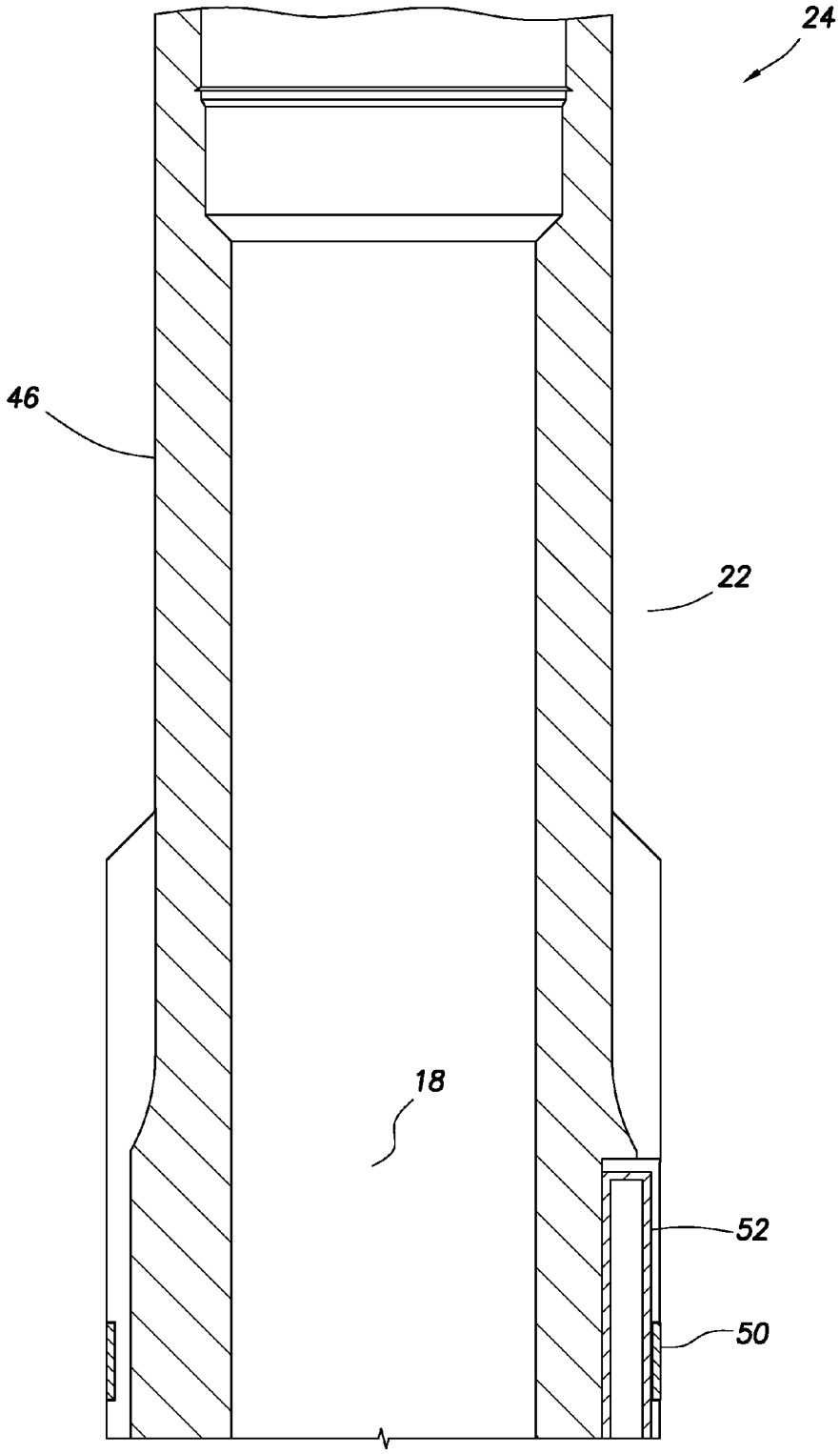
FIGS. 4A-D are detailed cross-sectional views of successive axial sections of the apparatus.
Figure 4B:
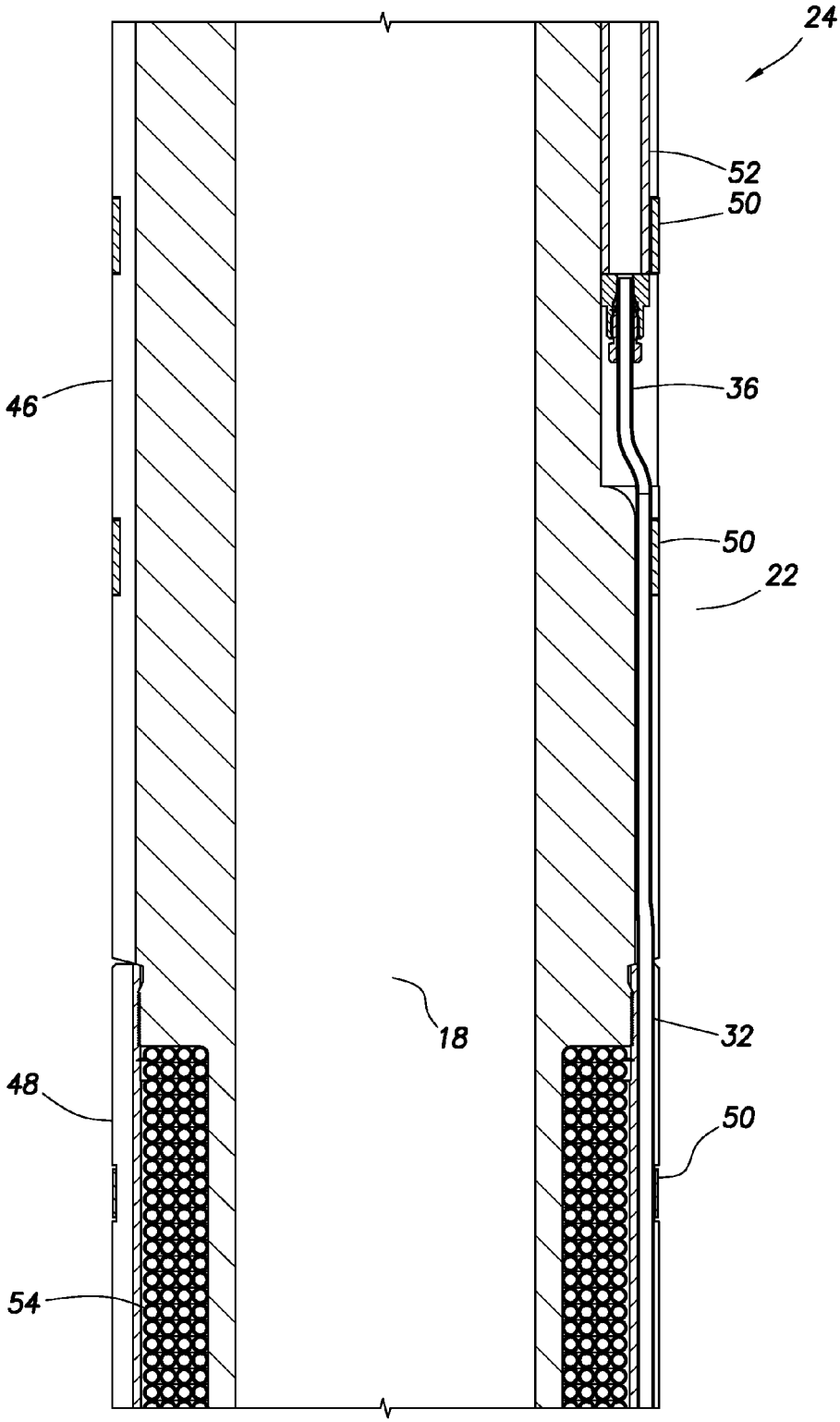
Figure 4C:
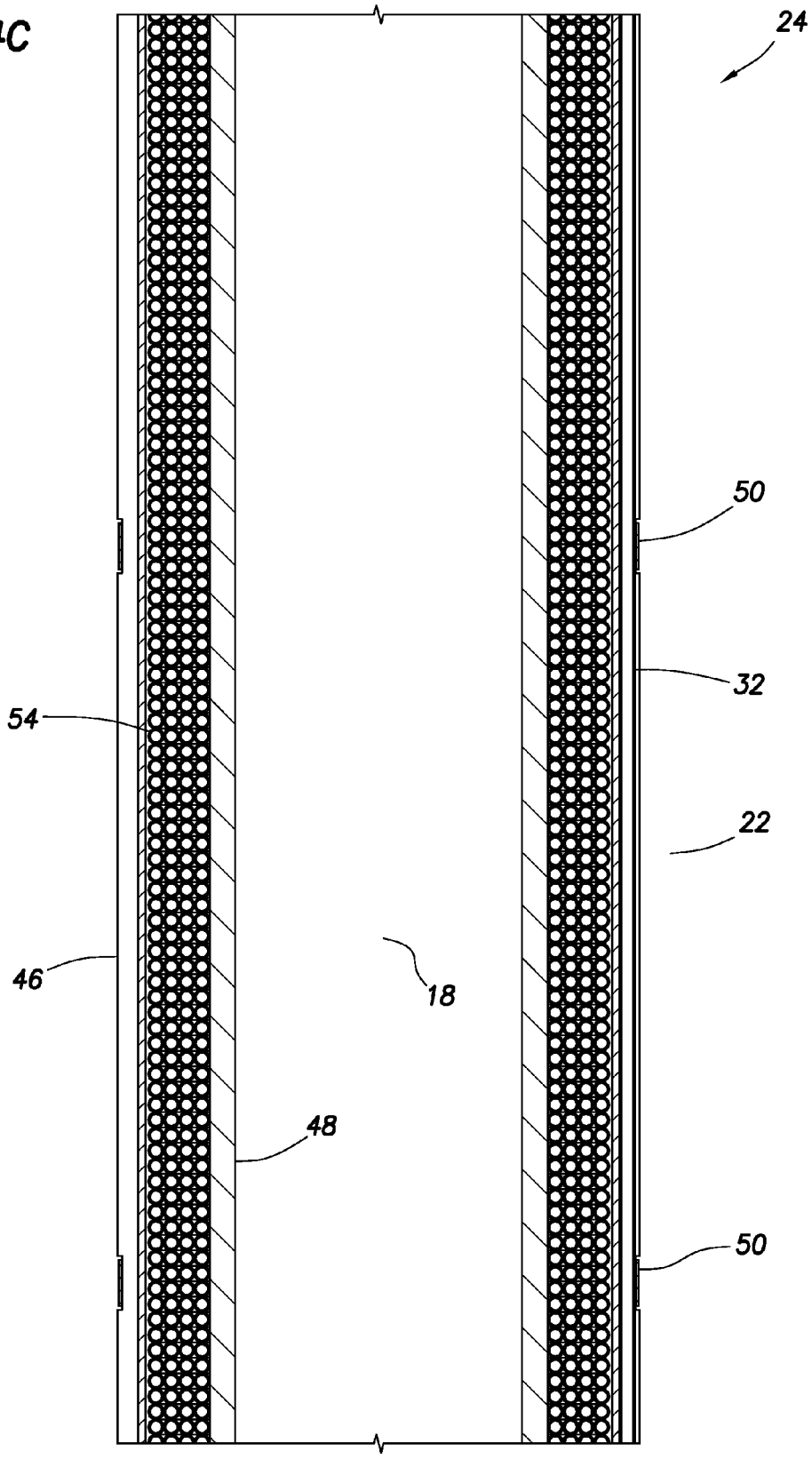
Figure 4D:
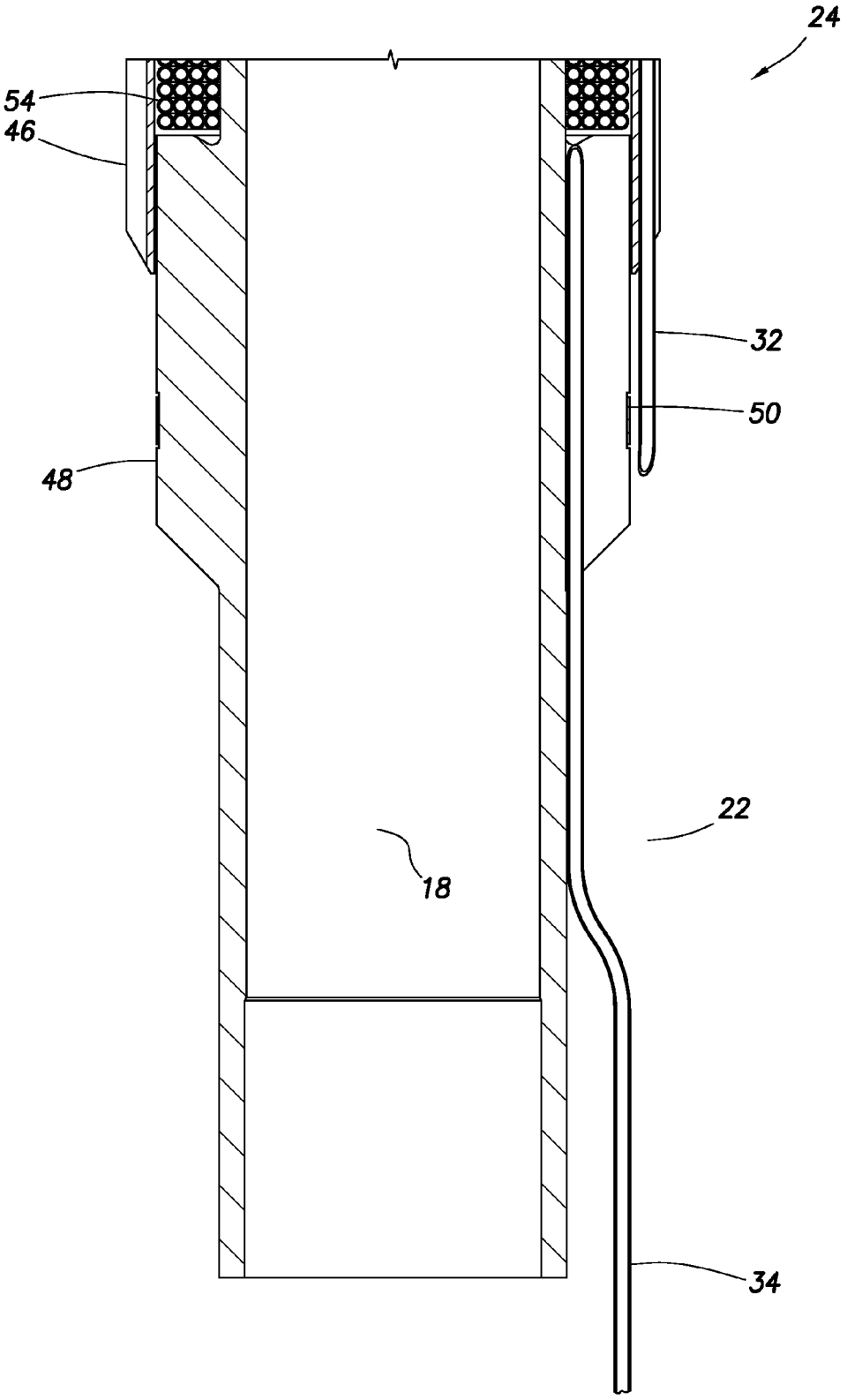

Referring additionally now to FIG. 2, an enlarged scale schematic view of the well tool 16 and pressure equalization apparatus 24 is representatively illustrated, apart from the remainder of the well system 10. In this view it may be seen that the chamber 20 contains one fluid 26 which almost completely fills a flowpath 30 within a tube 32 of the apparatus 24. Another fluid 28 is introduced from a source (such as the passage 18 or annulus 22).

One end 34 of the tube 32 is connected to the chamber 20, and an opposite end 36 of the tube is connected to the source of the fluid 28. Between the ends 34 and 36 of the tube 32, the tube extends alternately upward and downward.

In this example, an electrical assembly 38 (e.g., including an electronic circuit 40 and an electrical motor 42, for example, to operate the closure device 17) is positioned in the chamber 20, and the fluid 26 is a dielectric fluid used to insulate about the assembly and provide for heat transfer while transmitting pressure to avoid high pressure differentials across the walls of the chamber. The fluid 28, in contrast, may be a well fluid which is corrosive and/or conductive, and which could damage the assembly 38, or at least render it inoperative.

Note that the apparatus 24 permits pressure to be transmitted through the flowpath 30, but prevents the fluid 28 from migrating to the end 34 of the tube 32 and into the chamber 20. Because of the upward and downward undulations of the tube 32 between its opposite ends 34, 36, the fluid 28 would have to flow alternately upward and downward multiple times in order to migrate from the end 36 to the end 34.

However, since the fluids 26, 28 preferably have different densities, only one such upward or downward flow of the fluid 28 is to be expected as a result of its density. The fluid 28 may flow somewhat further into the tube 32 due to transmission of pressure from the source 18 or 22 to the chamber 20, but an interface 44 between the fluids 26, 28 is expected to remain in the tube between the opposite ends 34, 36.

The flowpath 30 also provides a conduit for extending a line 43 (such as an electrical or fiber optic line) into the chamber 20. This feature eliminates the need for any additional penetrations of the wall of the chamber 20, for example, to provide power and/or data communication for the assembly 38.

Referring additionally now to FIGS. 3A-D, a more detailed example of the apparatus 24 is representatively illustrated in successive elevational views. The apparatus 24 is representatively illustrated in successive cross-sectional views in FIGS. 4A-D.

The apparatus 24 includes a generally tubular housing 46 and a generally tubular cover sleeve 48. Clamps and other types of retainers 50 are used to secure the tube 32 to the housing 46. A filter 52 is provided at the upper end 36 of the tube 32 to prevent debris from entering the tube.

In this example, the end 36 of the tube 32 is in communication with the annulus 22. It will be appreciated that, in other examples, the end 36 of the tube 32 could readily be placed in fluid communication with the passage 18 in the tubular string 12.

The tube 32 extends downwardly from the filter 52 to a lower end of the sleeve 48. The tube 32 is then wrapped spirally or helically about the housing 46 in an upward direction. The tube 32 is then wrapped spirally about the housing 46 in a downward direction. The tube 32 is then again wrapped spirally about the housing 46 in an upward direction. And then, the tube 32 is again wrapped spirally about the housing 46 in a downward direction. The lower end 36 of the tube 32 then extends outward from under the sleeve 48 for connection to the chamber 20 of the well tool 16.

Thus, the tube 32 extends alternately upwardly and downwardly in respective successive spiral wraps 54 of the tube. In this example, there are four such spiral wraps 54 of the tube 32. Of course, any number of wraps 54 may be used, as desired to produce a corresponding desired volume of the fluid 26 in the tube 32.

It may now be fully appreciated how the apparatus 24 prevents the fluid 28 from entering the chamber 20, while still permitting unrestrained pressure equalization between the chamber and the source of the fluid. Firstly, the volume of the flowpath 30 in the tube 32 is selected to provide pressure equalization between the chamber 20 and the source of the fluid 28 at expected downhole pressures, and preferably the volume of the flowpath is much greater than that required to provide such pressure equalization. Secondly, the relatively small cross-sectional size of the flowpath 30 promotes surface tension adhesion between the fluid 28 and the interior wall of the tube 32, thereby inhibiting migration of the fluid through the tube. Thirdly, the alternating upward and downward orientation of the flowpath 30 promotes segregation of the fluids 26, 28 due to their different densities.

Furthermore, the apparatus 24 provides compensation for volume changes in the chamber 20 and fluid 26. When the volume of the fluid 26 in the chamber 20 changes (or the volume of the chamber itself changes) due, for example, to pipe swell, physical displacement (e.g., displacement of some component by the motor 42, etc.) and/or temperature fluctuation, the apparatus 24 as both a source and storage reservoir for the clean dielectric fluid 26.

For example, as the fluid 26 heats up in the chamber 20 the fluid flows into the tube 32, and when the fluid cools down it flows (still clean) back into the chamber. The apparatus 24 is uniquely designed to allow the fluid 26 to flow freely into and out of the tube 32 at one end 34, while allowing the other fluid 28 to flow freely into and out of the tube at the other end 36, with no (or only minimal) mixing of the fluids at their interface 44 (which is at a safe distance from the chamber).

Accordingly, the apparatus 24 provides for pressure equalization without permitting the fluid 28 to flow through the tube 32 into the chamber 20. This result is accomplished without use of any dynamic seals, without any pressure differential to cause a leak in any part of the apparatus 24, with a readily adjustable volume of the fluid 26 in the tube 32 (the volume being dependent only on the length and inner diameter of the tube), and with readily available components (such as the tube) and simply machined parts (such as the housing 46 and sleeve 48).

The above disclosure provides a well system 10 which comprises a well tool 16 including a chamber 20 therein containing an electrical assembly 38 in a dielectric fluid 26. A pressure equalization apparatus 24 includes a flowpath 30 having opposite ends 34, 36. One end 34 is connected to the chamber 20, and the other end 36 is connected to a source 18 or 22 of another fluid 28. The flowpath 30 extends alternately upward and downward between the ends 34, 36.

The flowpath 30 may comprise an interior passage of a tube 32. The flowpath 30 may extend helically about a flow passage 18 extending longitudinally through a tubular string 12. The flowpath 30 may extend upwardly and downwardly in respective successive spiral wraps 54 about the flow passage 18 extending longitudinally through the tubular string 12.

The fluid 28 may be conductive. A pressure in the chamber 20 may be equal to a pressure at the source 18 or 22 of the fluid 28. The source of the fluid 28 may be an interior longitudinal passage 18 of a tubular string 12 and/or an annulus 22 between the tubular string 12 and a wellbore 14.

The fluid 28 may enter the end 36 of the flowpath 30, but is prevented from flowing to the other end 34 of the flowpath. A density of the fluid 26 may be different from a density of the other fluid 28.

The well tool 16 may comprise a safety valve.

Also provided by the above disclosure is the pressure equalization apparatus 24 for use with a well tool 16 in a subterranean well. The apparatus 24 includes multiple spiral wraps 54 of a tube 32, a flowpath 30 in the tube 32 extending in opposite directions in respective successive wraps 54 of the tube 32.

The opposite directions may be respective upward and downward directions. The flowpath 30 may extend helically about a flow passage 18 extending longitudinally through the apparatus 24.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of the present disclosure. Accordingly, the foregoing detailed description is to be clearly understood as being given by way of illustration and example only, the spirit and scope of the present invention being limited solely by the appended claims and their equivalents.

What is claimed is:

1. A well system, comprising:

a well tool including a chamber therein containing an electrical assembly in a dielectric first fluid; and a pressure equalization apparatus including a flowpath having first and second opposite ends, the first end being connected to the chamber, the second end being connected to a source of a second fluid, the flowpath extending alternately upward and downward between the first and second ends, a line extending through the flowpath, and pressure transmission through the first and second opposite ends.

2. The system of claim 1, wherein the flowpath comprises an interior passage of a tube.

3. The system of claim 1, wherein the flowpath extends helically about a flow passage extending longitudinally through a tubular string.

4. The system of claim 1, wherein the flowpath extends upwardly and downwardly in respective successive spiral wraps about a flow passage extending longitudinally through a tubular string.

5. The system of claim 1, wherein a pressure in the chamber is equal to a pressure at the second fluid source.

6. The system of claim 1, wherein the second fluid source comprises at least one of an interior longitudinal passage of a tubular string, and an annulus between the tubular string and a wellbore.

7. The system of claim 1, wherein the second fluid enters the second end of the flowpath, but is prevented from flowing to the first end of the flowpath.

8. The system of claim 1, wherein the well tool comprises a safety valve.

9. The system of claim 1, wherein a density of the first fluid is different from a density of the second fluid.

10. The system of claim 1, wherein fluid communication is permitted through the first and second opposite ends.

11. A pressure equalization apparatus for use with a well tool in a subterranean well, the apparatus comprising:

multiple spiral wraps of a tube, a flowpath in the tube extending in first and second opposite directions in respective successive wraps of the tube, a line extending through the flowpath, and pressure transmission through first and second opposite ends of the flowpath.

12. The apparatus of claim 11, wherein the first and second directions comprise respective upward and downward directions.

13. The apparatus of claim 11, wherein the flowpath extends helically about a flow passage extending longitudinally through the apparatus.

14. The apparatus of claim 11, wherein a first end of the tube is connected to a chamber having a dielectric first fluid therein, and wherein a second end of the tube is connected to a source of a second fluid.

15. The apparatus of claim 14, wherein a pressure in the chamber is equal to a pressure at the second fluid source.

16. The apparatus of claim 14, wherein the second fluid source comprises at least one of an interior longitudinal passage of a tubular string, and an annulus between the tubular string and a wellbore.

17. The apparatus of claim 14, wherein the second fluid enters the second end of the tube, but is prevented from flowing to the first end of the tube.

18. The apparatus of claim 14, wherein a density of the first fluid is different from a density of the second fluid.

19. The apparatus of claim 14, further comprising an electrical assembly within the chamber.

20. The apparatus of claim 11, wherein fluid communication is permitted through the first and second opposite ends.

* * * * *